US009536657B2

(12) United States Patent
Omura et al.

(10) Patent No.: US 9,536,657 B2
(45) **Date of Patent: *Jan. 3, 2017**

(54) GRAIN ORIENTED ELECTRICAL STEEL SHEET AND METHOD FOR MANUFACTURING THE SAME

(75) Inventors: Takeshi Omura, Tokyo (JP); Hiroaki Toda, Tokyo (JP); Hiroi Yamaguchi, Tokyo (JP); Seiji Okabe, Tokyo (JP)

(73) Assignee: JFE Steel Corporation (JP)

( * ) Notice: Subject to any disclaimer, the term of this patent is extended or adjusted under 35 U.S.C. 154(b) by 331 days.

This patent is subject to a terminal disclaimer.

(21) Appl. No.: 13/805,109

(22) PCT Filed: Jun. 28, 2011

(86) PCT No.: PCT/JP2011/003690

§ 371 (c)(1),
(2), (4) Date: Jan. 7, 2013

(87) PCT Pub. No.: WO2012/001957

PCT Pub. Date: Jan. 5, 2012

(65) Prior Publication Data

US 2013/0112319 A1 May 9, 2013

(30) Foreign Application Priority Data

Jun. 29, 2010 (JP) ..... 2010-148307

(51) Int. Cl.

| | |
|---|---|
| ***H01F 41/00*** | (2006.01) |
| ***C21D 8/12*** | (2006.01) |
| ***H01F 1/16*** | (2006.01) |
| ***C22C 38/02*** | (2006.01) |

(52) U.S. Cl.

CPC ..... *H01F 41/00* (2013.01); *C21D 8/1222* (2013.01); *C21D 8/1233* (2013.01); *C21D 8/1272* (2013.01); *C21D 8/1288* (2013.01); *C22C 38/02* (2013.01); *H01F 1/16* (2013.01)

(58) Field of Classification Search

CPC ..... C21D 8/12; C22C 38/02
USPC ..... 148/100, 111, 306
See application file for complete search history.

(56) References Cited

U.S. PATENT DOCUMENTS

| | | | | | |
|---|---|---|---|---|---|
| 4,212,689 | A | * | 7/1980 | Shimizu et al. | 148/111 |
| 4,293,350 | A | | 10/1981 | Ichiyama et al. | |
| 5,702,539 | A | * | 12/1997 | Schoen et al. | 148/111 |
| 6,110,298 | A | * | 8/2000 | Senda et al. | 148/308 |
| 2009/0145526 | A1 | * | 6/2009 | Arai et al. | 148/512 |

FOREIGN PATENT DOCUMENTS

| | | | | |
|---|---|---|---|---|
| JP | 57-2252 | | | 1/1982 |
| JP | 2-70020 | A | | 3/1990 |
| JP | 06200325 | A | * | 7/1994 |
| JP | 8-291390 | A | | 11/1996 |
| JP | 9-184017 | A | | 7/1997 |
| JP | 09184017 | A | * | 7/1997 |
| JP | 10-204533 | | | 8/1998 |
| JP | 11-279645 | A | | 10/1999 |
| JP | 11-335794 | A | | 12/1999 |
| JP | 2000-063950 | A | | 2/2000 |
| JP | 2000 119824 | A | | 4/2000 |
| JP | 2002194445 | | | 7/2002 |
| JP | 2002194445 | A | * | 7/2002 |
| JP | 2006-117964 | A | | 5/2006 |
| JP | 2007-138201 | A | | 6/2007 |

OTHER PUBLICATIONS

NPL: Kuroki et al, English machine translation of JP06200325A, Jul. 1994.*

Office Action of corresponding Japanese Application No. 2011-142578 dated Feb. 3, 2015 with English translation.

Mexican Office Action dated May 18, 2015 of corresponding Mexican Application No. MX/a/2012/014567 along with its English translation.

* cited by examiner

*Primary Examiner* — Jie Yang
(74) *Attorney, Agent, or Firm* — DLA Piper LLP (US)

(57) ABSTRACT

A grain oriented electrical steel sheet is subjected to magnetic domain refinement by laser irradiation and has magnetic flux density $B_8$ of at least 1.91T, wherein the nitrogen content in the forsterite coating is 3.0 mass % or less. The grain oriented electrical steel sheet satisfies recent demand for iron loss reduction.

4 Claims, No Drawings

GRAIN ORIENTED ELECTRICAL STEEL SHEET AND METHOD FOR MANUFACTURING THE SAME

RELATED APPLICATIONS

This is a §371 of International Application No. PCT/JP2011/003690, with an international filing date of Jun. 28, 2011 (WO 2012/001957 A1, published Jan. 5, 2012), which is based on Japanese Patent Application No. 2010-148307, filed Jun. 29, 2010, the subject matter of which is incorporated herein by reference.

TECHNICAL FIELD

This disclosure relates to a grain oriented electrical steel sheet for use in an iron core material of a transformer or the like and a method for manufacturing the grain oriented electrical steel sheet.

BACKGROUND

A grain oriented electrical steel sheet is mainly utilized as an iron core of a transformer and required to exhibit superior magnetization characteristics, e.g. low iron loss in particular.

In this regard, it is important to highly accumulate secondary recrystallized grains of a steel sheet in (110)[001] orientation, i.e. what is called "Goss orientation", and reduce impurities in a product steel sheet. However, there are restrictions on controlling crystal grains and reducing impurities in view of production cost. Accordingly, there has been developed a technique of introducing non-uniformity into a surface of a steel sheet by physical means to subdivide width of a magnetic domain to reduce iron loss, i.e. magnetic domain refinement technique.

For example, JP-B 57-002252 proposes a technique of irradiating a steel sheet as a finished product with laser to introduce linear, high-dislocation density regions into a surface layer of the steel sheet, thereby narrowing magnetic domain widths and reducing iron loss of the steel sheet. The magnetic domain refinement technique using laser irradiation of JP-B 57-002252 was improved thereafter (see JP-A 2006-117964, JP-A 10-204533, JP-A 11-279645 and the like), so that a grain oriented electrical steel sheet having good iron loss properties can be obtained.

Further, JP-A 2000-119824 discloses an experiment example of improving iron loss by laser irradiation as a method for improving iron loss properties of a steel sheet in a component system not using an inhibitor (i.e. an inhibitorless component system). Yet further, JP-A 2007-138201 discloses an example of reducing iron loss of a steel sheet by specifying a titanium compound added to an annealing separator and annealing atmosphere during final annealing when an inhibitorless steel material is used.

Various technical improvements have been made for the magnetic domain refinement technique as described above. However, there is a demand for further improvement of iron loss properties of a grain oriented electrical steel sheet due to increasing public awareness of energy-saving and environment protection in recent years.

However, none of the grain oriented electrical steel sheets disclosed in JP-B 57-002252, JP-A 2006-117964, JP-A 10-204533, JP-A 11-279645 can achieve sufficiently low iron loss values satisfying such a public demand as described above. Further, JP-A 2000-119824 and JP-A 2007-138201 also have such problems as described below.

That is, JP-A 2000-119824 improves iron loss properties by restricting Al content in steel, but pays no attention as to how compounds in forsterite coating (coating mainly composed of $Mg_2SiO_4$) affects laser irradiation and fails to obtain a sufficient magnetic domain refinement effect by laser. A sufficient magnetic domain refinement effect by laser cannot be obtained solely by the controlling techniques described in JP-A 2007-138201 as well.

SUMMARY

We thus provide:

[1] A grain oriented electrical steel sheet subjected to magnetic domain refinement by laser irradiation and having magnetic flux density $B_8$ of at least 1.91 T, characterized in that nitrogen content in forsterite undercoating is suppressed to 3.0 mass % or less.

[2] The grain oriented electrical steel sheet of [1] above, wherein aluminum content and titanium content in the forsterite undercoating are suppressed to 4.0 mass % or less and 0.5-4.0 mass %, respectively.

[3] The grain oriented electrical steel sheet of [1] or [2] above, wherein the standard deviation of forsterite grain size in the forsterite undercoating is equal to or less than 1.0 time as much as the average of the forsterite grain size.

[4] A method for manufacturing a grain oriented electrical steel sheet, comprising the steps of: preparing a steel slab such that aluminum and nitrogen contents thereof at steel smelting stage are Al: 0.01 mass % or less and N, 0.005 mass % or less, respectively; subjecting the steel slab to hot rolling and then cold rolling to obtain a cold rolled steel sheet; subjecting the cold rolled steel sheet to decarburizing annealing; coating a surface of the steel sheet with annealing separator containing a titanium compound (other than a nitride) by 0.5 to 4 parts by mass in $TiO_2$ conversion with respect to 100 parts by mass of MgO; employing an inert gas atmosphere not containing $N_2$ as an annealing atmosphere in heating process of subsequent final annealing at least in a temperature range from 750° C. to 850° C.; employing a gas atmosphere of which $N_2$ partial pressure is controllably set to be 25% or less as an annealing atmosphere in heating process of the final annealing at temperature equal to or higher than 1100° C.; and subjecting the steel sheet to magnetic domain refinement by laser irradiation after the final annealing.

[5] The method for manufacturing a grain oriented electrical steel sheet of [4] above, further comprising controllably setting the maximum difference in end-point temperatures within a coiled steel sheet to be in the range of 20° C. to 50° C. in the final annealing.

It is possible to improve the effect of reducing iron loss by magnetic domain refinement with a laser to further reduce iron loss of a steel sheet. Consequently, it is possible to obtain a transformer having high energy consumption efficiency by using the grain oriented electrical steel sheet as an iron core of the transformer.

DETAILED DESCRIPTION

We discovered that contents of nitrides (mainly Al, Ti-based nitrides) in forsterite undercoating and uniformity of forsterite grain size in the forsterite coating significantly affect iron loss reduction.

Specifically, we found that when the total content of nitrides (mainly Ti, Al-based nitrides) present in forsterite coating exceeds a certain value, thermal conductivity of the coating is locally changed and a thermal strain-imparting effect caused by laser irradiation is made non-uniform, whereby the iron loss-reducing effect cannot be sufficiently obtained. Further, we found that, when sizes of forsterite grains are not even, strains fail to be introduced through these grains as uniformly as expected and thus the iron-loss reducing effect cannot be sufficiently obtained.

Next, we discovered with respect to the relationship between the total content of nitrides in forsterite coating and an iron-loss reducing effect by laser irradiation that the iron-loss reducing effect is remarkably improved by suppressing nitrogen content in forsterite undercoating to 3.0 mass % or less. Further, we discovered with respect to the relationship between uniformity of forsterite grain size and an iron-loss reducing effect by laser irradiation that the iron-loss reducing effect is remarkably improved by: controllably setting contents of aluminum and titanium contained by relatively high concentrations in forsterite undercoating to be 4.0 mass % or less and 0.5-4.0 mass %, respectively, to suppress variation in composition of forsterite undercoating; and setting the standard deviation of forsterite grain size to be equal to or less than 1.0 time as much as the average of the grain size.

Specifically, important features regarding nitrogen content of forsterite undercoating reside in following four aspects (1)-(4) and the important features regarding evenness of forsterite grain size reside in following five aspects (1)-(5).

(1) Contents of Al and N in molten steel is to be Al: 0.01 mass % or less and N, 0.005 mass % or less, respectively, in steelmaking process.

(2) Content of titanium compound (other than a nitride) in annealing separator is to be 4 parts by mass or less in $TiO_2$ conversion with respect to 100 parts by mass of MgO.

(3) An atmosphere in heating process of the final annealing at least in a temperature range from 750° C. to 850° C. is to be an inert gas atmosphere not containing $N_2$.

(4) An atmosphere in heating process of the final annealing at temperature equal to or higher than 1100° C. is to be an atmosphere of which $N_2$ partial pressure is controllably set to be 25% or less.

(5) The maximum difference in end-point temperatures within a coiled steel sheet is to be in the range of 20° C. to 50° C. in the final annealing.

Our steel sheets and methods will be described in detail hereinafter.

A material having secondary recrystallized grains highly accumulated in Goss orientation to exhibit relatively high magnetic flux density need be used to achieve such high level of iron loss reduction as demanded in recent years, as described above. In this regard, the grain oriented electrical steel sheet is restricted to a grain oriented electrical steel sheet having $B_8$ ("$B_8$" represents magnetic flux density when a steel sheet is magnetized at 800 A/m and is generally used as an index of accumulation of secondary recrystallized grain orientations) of at least 1.91 T.

Further, it is important to reduce nitride (mainly Al, Ti-based nitrides) inevitably existing in forsterite undercoating, which coating is an oxide in itself, to uniformly impart a surface layer of a steel sheet with thermal strain by laser irradiation. For this purpose, nitrogen content in forsterite undercoating is to be restricted to 3.0 mass % or less, more preferably 2.0 mass % or less, in the grain oriented electrical steel sheet. The lower limit of nitrogen content in forsterite undercoating need not be particularly set because absence of nitrogen in forsterite undercoating does not cause any problem.

It is effective to more uniformly impart a surface layer of a steel sheet with thermal strain by laser irradiation, to controllably set contents of aluminum and titanium contained by relatively high concentrations in forsterite undercoating to 4.0 mass % or less, more preferably 2.0 mass % or less, respectively, so that the maximally uniform composition of forsterite undercoating is achieved. The lower limit of Ti content in forsterite undercoating is, however, preferably 0.5 mass % because titanium causes an effect of strengthening forsterite undercoating to enhance tension thereof and this effect is demonstrated when the Ti content is equal to or higher than 0.5 mass % or so. In contrast, the lower limit of Al content in forsterite undercoating need not be particularly set because absence of aluminum in forsterite undercoating does not cause any problem. Controllably setting contents of aluminum and titanium contained in forsterite undercoating to 4.0 mass %, respectively, not only makes composition of the forsterite-based coating uniform but also effectively reduces nitrides in the forsterite undercoating because nitrides in the coating are mainly Al, Ti-based nitrides.

Further, size distribution of forsterite grains is preferably made even by setting the standard deviation of forsterite grain size to be equal to or less than 1.0 time, preferably 0.75 times, and more preferably 0.5 times as much as the average of the forsterite grain size.

Next, important features regarding manufacturing conditions of the grain oriented electrical steel sheet will be described. Regarding features other than the "important features" described below, conventionally known manufacturing conditions of a grain oriented electrical steel sheet and conventionally known magnetic domain refinement by using laser may be applied thereto.

A first important feature relates to components of molten steel.

It is necessary to set contents of Al and N in molten steel to be Al: 0.01 mass % or less and N, 0.005 mass % or less, respectively, in steel smelting process. Too high an Al content in molten steel inhibits release of nitrogen or denitrization from a steel sheet (composed of base iron and coating thereon) in the purification process, thereby allowing too much nitride to remain in the forsterite undercoating. Further, too high an Al content in the molten steel makes the composition of forsterite grains non-uniform because it is impossible to release a large amount of Al from a steel sheet in the purification process. Accordingly, the Al content in the molten steel is to be restricted to 0.01 mass % or less. Nitrogen, on the other hand, can be removed in processes after the steel smelting process. The nitrogen content in molten steel is, however, to be restricted to 0.005 mass % or less because too high a nitrogen content requires significant time and cost for removal of nitrogen.

Regarding the titanium content in the molten steel, the Ti content does not particularly matter as long as it stays at the general impurity level (i.e. 0.005 mass % or less) because the annealing separator contains some amount of titanium as a precondition.

Other components of the molten steel than described above may be appropriately determined based on compositions of the conventional grain oriented electrical steel sheets of various types so that $B_8$ of at least 1.91T is obtained.

It is noted that employing a method for manufacturing a grain oriented electrical steel sheet in an inhibitorless component system (what is called "inhibitorless method") is advantageous in terms of obtaining such high magnetic flux density as $B_8$ of at least 1.91 T, while reducing the contents of Al and N in the molten steel as described above. It is preferable to further add following elements to the molten steel in the case of inhibitorless method.

Preferable basic components, as well as components to be optionally added, in the inhibitorless method will be described hereinafter.

C: 0.08 mass % or less. Carbon is added to improve the texture of a hot rolled steel sheet. Carbon content in molten steel is preferably 0.08 mass % or less because a carbon content exceeding 0.08 mass % increases the burden of reducing the carbon content to 50 mass ppm at which magnetic aging is reliably prevented during the manufacturing process. The lower limit of carbon content in the molten steel need not be particularly set because secondary recrystallization is possible in a material not containing carbon.

Si: 2.0 mass % to 8.0 mass %. Silicon is an element which effectively increases electrical resistance of steel to improve iron loss properties thereof. The silicon content in the molten steel equal to or higher than 2.0 mass % ensures a particularly good effect of reducing iron loss. On the other hand, a Si content in the molten steel equal to or lower than 8.0 mass ensures particularly good formability and magnetic flux density of a resulting steel sheet. Accordingly, the Si content in the molten steel is 2.0 mass % to 8.0 mass %.

Mn: 0.005 mass % to 1.0 mass %. Manganese is an element which advantageously achieves good hot formability of a steel sheet. A manganese content in the molten steel less than 0.005 mass % cannot cause the good effect of Mn addition sufficiently. A manganese content in the molten steel equal to or lower than 1.0 mass % ensures particularly good magnetic flux density of a product steel sheet. Accordingly, Mn content in molten steel is preferably 0.005 mass % to 1.0 mass %.

The contents of aluminum and nitrogen in the molten steel need be reduced as best as possible as described above. It is preferable in this regard to set the contents of sulfur and selenium to be S: 50 mass ppm (0.005 mass %) or less and Se: 50 mass ppm (0.005 mass %), respectively, to obtain a grain oriented electrical steel sheet having sufficiently high magnetic flux density without utilizing Al and N as inhibitor components. However, needless to say, contents of S and Se exceeding the aforementioned upper limits do not cause a problem if a manufacturing method using an inhibitor is applied.

Further, the molten steel may contain the following elements as magnetic properties improving components in an appropriate manner in addition to the basic components described above.

At least one element selected from Ni: 0.03 mass % to 1.50 mass %. Sn: 0.01 mass % to 1.50 mass %, Sb: 0.005 mass % to 1.50 mass %, Cu: 0.03 mass % to 3.0 mass %, P: 0.03 mass % to 0.50 mass %, Mo: 0.005 mass % to 0.10 mass %, and Cr: 0.03 mass % to 1.50 mass %.

Nickel is a useful element in terms of further improving the microstructure of a hot rolled steel sheet and thus improving the magnetic properties of a steel sheet. A nickel content in the molten steel less than 0.03 mass % cannot cause the magnetic properties-improving effect by Ni sufficiently. A nickel content in the molten steel equal to or lower than 1.5 mass % ensures stability in secondary recrystallization to improve magnetic properties of a resulting steel sheet. Accordingly, the Ni content in the molten steel is preferably 0.03 mass % to 1.5 mass %.

Sn, Sb, Cu, P, Mo and Cr are useful elements, respectively, in terms of further improving magnetic properties of a steel sheet. Contents of these elements lower than the respective lower limits described above result in an insufficient magnetic properties-improving effect. Contents of these elements equal to or lower than the respective upper limits described above ensure the optimum growth of secondary recrystallized grains. Accordingly, it is preferable that the molten steel contains at least one of Sn, Sb, Cu, P, Mo and Cr within the respective ranges specified above.

The balance other than the aforementioned components of the molten steel is Fe and incidental impurities incidentally mixed into steel during the manufacturing process.

Either a slab may be produced by the conventional ingot/continuous casting method or a thin slab or a thin bar having thickness of 100 mm or less (such a thin slab or a thin bar is regarded as a kind of slab in the present invention) may be produced by direct continuous casting from molten steel having the chemical composition specified above. The slab thus produced is heated and hot rolled according to a conventional method, but may optionally be hot rolled without being heated immediately after casting. The thin slab or thin bar may be either directly hot rolled or skip hot rolling to proceed to the subsequent processes.

A hot rolled steel sheet thus obtained is then optionally subjected to hot-band annealing. The primary object of hot-band annealing is to eliminate band texture generated in hot rolling to make the grain size of primary recrystallized texture even, thereby allowing Goss texture to further grow during secondary recrystallization annealing so that magnetic properties of the steel sheet improve. The temperature in hot-band annealing is preferably 800° C. to 1100° C. in terms of ensuring excellent growth of Goss texture in a product steel sheet. A hot-band annealing temperature lower than 800° C. results in remaining of band texture derived from hot rolling, thereby making it difficult to realize uniform grain size of primary recrystallization texture and thus failing to improve secondary recrystallization as desired. On the other hand, a hot-band annealing temperature exceeding 1100° C. excessively coarsens grains after hot-band annealing, thereby making it difficult to realize uniform grain size of primary recrystallization texture.

After hot-band annealing, the steel sheet is further subjected to at least one cold rolling operation, with optional intermediate annealing between the cold rolling operations, and subsequent recrystallization annealing. The steel sheet is then coated with annealing separator. Increasing the cold rolling temperature to 100° C. to 250° C. and/or carrying out at least one aging treatment in the midst of cold rolling at temperature of 100° C. to 250° C. are advantageous in terms of sufficiently growing Goss texture.

A second important feature relates to controllably setting the content of titanium compound in the annealing separator coated after decarburizing annealing to be 4 parts by mass or less in $TiO_2$ conversion with respect to 100 parts by mass of MgO. Addition of a Ti compound is preferable in terms of enhancing tension of the forsterite undercoating and improving magnetic properties of a steel sheet, i.e., the Ti compound added to the annealing separator improves iron loss properties of the steel sheet through an increase in tension of the forsterite undercoating. The content-of the Ti compound in the annealing separator is to be restricted to 4 parts by mass or less, preferably 3 parts by mass or less, in $TiO_2$ conversion because too high a content of the Ti compound causes a portion of titanium to be bonded to nitrogen to form titanium nitride, and also makes composition of forsterite grains non-uniform. However, a content of the Ti compound lower than 0.5 parts by mass fails to cause an effect of improving forsterite undercoating and magnetic properties. Accordingly, the lower limit of the Ti compound content is to be 0.5 parts by mass.

The titanium compound is not titanium nitride and preferable examples thereof include $TiO_2$ as a titanium oxide compound, with no particular restriction thereto.

The annealing separator is mainly composed of MgO. "The annealing separator is mainly composed of MgO" means that the annealing separator may further contain known annealing separator components and property-improving components other than MgO unless the presence of such other components adversely affects formation of forsterite undercoating (and as long as requirements and/or preferred conditions of forsterite coating composition described above are satisfied).

A third important feature relates to employing an inert gas atmosphere not containing $N_2$ in the heating process of the final annealing at least at a temperature of 750° C. to 850° C. after application by coating of the annealing separator. This feature is to be realized to remove $N_2$ present in a steel sheet by denitrization prior to formation of forsterite. Removal of $N_2$ from a steel sheet in such a manner as described above suppresses not only formation of Al, Ti-based nitrides as main nitride components, but also formation of nitrides derived from V, Nb, B and the like as incidental impurities. Further, such removal of $N_2$ as described above, i.e. decrease in nitrogen content in a steel sheet, facilitates migration of Al in steel to a surface layer of the steel sheet and incorporation of most of such Al into unreacted annealing separator (which unreacted annealing separator is eventually removed by rinsing after annealing), thereby contributing to reduction of Al content in forsterite undercoating, as well.

Conditions of the atmospheric gas in connection with a specific temperature in the temperature range of 750° C. to 850° C. are as follows:

(1) When temperature is lower than 750° C., a denitrization reaction is disturbed due to too low temperature.

(2) When temperature exceeds 850° C., a denitrization reaction is disturbed due to formation of forsterite coating triggered by too high temperature.

(3) Introduction of $H_2$ to the atmosphere facilitates formation of forsterite coating, thereby starting formation of forsterite coating at temperature of 750° C. to 850° C. and disturbing a denitrization reaction. Accordingly, $H_2$ should not be introduced to the atmosphere. Further, the presence of $N_2$ in the atmosphere triggers a nitriding reaction. Accordingly, an atmosphere in the heating process of the final annealing at least at a temperature of 750° C. to 850° C. is restricted to an inert gas atmosphere not containing $N_2$.

The type of the inert gas is not particularly restricted as long as it is a conventionally known inert gas not containing $N_2$ and examples thereof include Ar, He and the like. Needless to say, $H_2$ gas and any gas generating $H_2$ gas belong to activated gas.

A fourth important feature relates to setting an atmosphere in the final annealing to realize satisfactory secondary recrystallization and formation of forsterite coating.

Specifically, the feature relates to employing an atmosphere having an $N_2$ partial pressure controllably set to 25% or less (the atmosphere is preferably a reducing atmosphere constituted of 100% $H_2$) as an atmosphere in the heating process of the final annealing at temperature equal to or higher than 1100° C. Although a steel sheet is unlikely to be nitrided in the final annealing when a forsterite coating has already been formed thereon, a nitriding reaction still occurs in the steel sheet when the temperature of the atmosphere is 1100° C. or higher. In such a case, unfavorably, nitrogen introduced to a steel sheet by a nitriding reaction may eventually form not only Al, Ti-based nitrides as main nitride components, but also nitrides of incidental impurities V, Nb, B and the like. Further, suppressing a nitriding reaction at a temperature equal to or higher than 1100° C. facilitates migration of Al in steel to a surface layer of the steel sheet and incorporation of most of such Al into unreacted annealing separator, thereby contributing to reduction of Al content in the forsterite coating as well. Accordingly, a ratio of $N_2$ in the final annealing atmosphere at temperature equal to or higher than 1100° C. is to be restricted to 25% or less. The atmosphere is preferably a reducing atmosphere constituted of 100% $H_2$.

A fifth important feature relates to controllably adjusting the maximum difference in end-point temperatures within a coiled steel sheet in the final annealing to preferably 20° C. to 50° C. This feature is to be realized to achieve satisfactory evenness of forsterite grain size. The maximum difference in end-point temperatures within a coiled steel sheet in the final annealing exceeding 50° C. results in facilitated growth of forsterite grains at a portion where temperature is relatively high as well as formation of grains different in not only size, but also characteristics at a portion where temperature is relatively low. Accordingly, the upper limit of the maximum difference in end-point temperatures within a coiled steel sheet in the final annealing is 50° C.

One might think that the smaller difference in end-point temperatures within a coiled steel sheet in the final annealing is more advantageous in terms of achieving good uniformity of forsterite grains. However, measures like slowing the heating rate are required to decrease the maximum difference in end-point temperatures and these measures extremely prolong annealing time. That is, a too small difference in end-point temperatures within a coiled steel sheet in the final annealing results in a variation of forsterite grain growth extent due to a too long annealing time. Accordingly, the lower limit of the aforementioned difference is 20° C. Controlling the heating rate by gradual heating is the easiest way to control the maximum difference in end-point temperatures within a coiled steel sheet in the final annealing, although a method for the control is not particularly restricted.

Shape correction is effectively carried out by flattening annealing after the final annealing. In a case where steel sheets are to be stacked in use, providing a surface of each steel sheet with an insulating coating either before or after the flattening annealing is effective in improving iron loss properties of the steel sheet. The insulating coating is preferably that capable of imparting a steel sheet with tension to reduce iron loss. Examples of coating capable of imparting a steel sheet with tension include inorganic coating containing silica, ceramic coating formed by physical deposition, chemical deposition, and the like.

Magnetic domain refinement is carried out by irradiating a steel sheet surface with a laser at some stage after the final annealing. In this regard, thermal strain caused by laser irradiation is uniformly introduced to a surface layer of a steel sheet and a magnetic domain refinement effect is sufficiently demonstrated by: (1) suppressing the nitrogen content in the forsterite coating to 3.0 mass % or less; (2) controllably setting the contents of Al and Ti contained in the forsterite coating to 4.0 mass % or less and 0.5-4.0 mass %, respectively; and (3) setting the standard deviation of forsterite grain size to be equal to or less than 1.0 time as much as the average of the forsterite grain size, as described above.

Either continuous-wave laser or pulse laser can be used as a laser source to be irradiated. Types of laser, e.g. YAG laser, $CO_2$ laser and the like, are not restricted. The laser-irradiated mark may take on either a linear or spot-like shape. The laser-irradiated mark is preferably inclined by 90° to 45° with respect to the rolling direction of a steel sheet.

Green laser marking, which has been increasingly used recently, is particularly preferable in terms of irradiation precision.

Laser output of green laser marking is preferably 5 μm to 100 μm when expressed as quantity of heat per unit length. The spot diameter of the laser beam is preferably 0.1 mm to 0.5 mm and the repetition interval in the rolling direction is preferably 1 mm to 20 mm.

The depth of plastic strain imparted to a steel sheet is preferably 10 μm to 40 μm. The effect of magnetic domain refinement is enhanced by setting the depth of plastic strain to 10 μm or more. Setting the depth of plastic strain to be equal to or less than 40 μm ensures improvement of magnetostriction properties in particular.

EXAMPLES

A steel slab having a chemical composition as shown in Table 1 (the balance was Fe and incidental impurities) was prepared by continuous casting. The steel slab was heated to 1400° C. and hot-rolled to sheet thickness: 2.0 mm to obtain a hot rolled steel sheet. The hot rolled steel sheet was subjected to hot-band annealing at 1000° C. for 180 seconds. The steel sheet was then subjected to first cold rolling to the intermediate sheet thickness: 0.75 mm, intermediate annealing under the conditions of degree of oxidation ($PH_2O/PH_2$)=0.30, temperature: 830° C., and retention time: 300 seconds, pickling with hydrochloric acid to remove subscales on steel sheet surfaces, and second cold rolling to sheet thickness: 0.23 mm in that order to obtain a cold rolled steel sheet.

TABLE 1

| Steel sample | Chemical composition (mass % for Si, Mn and Ni, mass ppm for C, O, N, Al ,Se and S) | | | | | | | | |
|---|---|---|---|---|---|---|---|---|---|
| ID | C | Si | Mn | Ni | O | N | Al | Se | S |
| A | 300 | 3.25 | 0.03 | 0.01 | 20 | 38 | 60 | tr | 20 |
| B | 400 | 3.30 | 0.05 | 0.10 | 25 | 40 | 70 | tr | 15 |
| C | 700 | 3.05 | 0.12 | 0.01 | 18 | 25 | 40 | tr | 20 |
| D | 300 | 3.25 | 0.04 | 0.01 | 17 | 45 | 130 | tr | 20 |
| E | 550 | 3.40 | 0.05 | 0.01 | 10 | 65 | 90 | tr | 10 |
| F | 600 | 3.10 | 0.07 | 0.01 | 9 | 25 | 30 | 100 | 30 |

Next, the cold rolled steel sheet thus obtained was subjected to decarburizing annealing under the conditions of degree of oxidation ($PH_2O/PH_2$)=0.45, soaking temperature: 840° C., and retention time: 200 seconds, and then coated with annealing separator mainly constituted of MgO. $TiO_2$ was added to the annealing separator at various ratios as shown in Table 2. Specifically, the content of $TiO_2$ with respect to MgO: 100 parts by mass was changed in the range of 0 to 6 parts by mass (pbm). The steel sheet was then subjected to final annealing for secondary recrystallization and purification at 1230° C. for 5 hours.

The final annealing was carried out in a temperature range from 750° C. to 850° C. and at temperatures equal to or higher than 1100° C. were changed as shown in Table 2, respectively, and a mixed atmosphere of $N_2$: $H_2$=50:50 was used in the rest of the final annealing process. The end-point temperatures within a coiled steel sheet was determined by: measuring the temperature of the steel sheet with thermocouples mounted at respective ends and at the center portion in the sheet-widthwise direction of a radially outer portion, a radially intermediate portion and a radially inner portion of the coiled steel sheet; and calculating the maximum difference in temperatures from the measurement results. The difference in end-point temperature of the coiled steel sheet was changed within the range of 10° C. to 100° C. by changing the heating rate in our Examples. The steel sheet was then provided with an insulating coating composed of 50% colloidal silica, and magnesium phosphate. Finally, the steel sheet was subjected to magnetic domain refinement of irradiating the steel sheet with pulse laser linearly under the conditions of irradiation width orthogonal to the rolling direction: 150 μm, and irradiation interval: 7.5 mm, to obtain a product steel sheet.

The production conditions, magnetic properties, analysis results of nitrogen content in forsterite coating, and the like are shown in Table 2.

Contents of N, Al and Ti in the forsterite coating were determined by collecting only forsterite coating from the product steel sheet and analyzing the forsterite coating through wet chemical analysis. The average value and the standard deviation of forsterite grain size were calculated by: removing the insulating coating from the product steel sheet by using alkali solution; observing a steel sheet surface thus exposed by using a scanning electron microscope (SEM); determining circles approximating respective forsterite grains within a 0.5 mm×0.5 mm region and measuring diameters of these circles as grain sizes through an image analyzing software; and carrying out necessary calculations. Magnetic properties were evaluated by measurement according to JIS C2550.

TABLE 2

| No. | Steel sample ID | $TiO_2$ content (pbm) in annealing separator | Atmosphere in temperature range 750° C.-850° C. in heating process of final annealing | Atmosphere at temperature ≥ 1100° C. in final annealing | Difference in maximum end-point temperature of coiled steel sheet in final annealing (° C.) | N content in forsterite coating (mass %) | Ti content in forsterite coating (mass %) | Al content in forsterite coating (mass %) | Average of forsterite grain size (μm) | Ratio of STD with respect to average forsterite grain size | $W_{17/50}$ (W/kg) | $B_8$ (T) | Note |
|---|---|---|---|---|---|---|---|---|---|---|---|---|---|
| 1 | A | 0 | Ar:100% | $H_2$:100% | 25 | 0.8 | 0.1 | 1.2 | 0.25 | 0.45 | 0.68 | 1.93 | Example |
| 2 | | 0 | Ar:100% | | 10 | 0.8 | 0.1 | 1.2 | 0.33 | 1.50 | 0.70 | 1.93 | Example |
| 3 | | 0.3 | Ar:100% | | 40 | 1.5 | 0.3 | 1.2 | 0.25 | 0.70 | 0.69 | 1.93 | Example |
| 4 | | 2 | Ar:100% | | 25 | 1.8 | 1.5 | 1.2 | 0.23 | 0.35 | 0.66 | 1.93 | Example |

TABLE 2-continued

| No. | Steel sample ID | $TiO_2$ content (pbm) in annealing separator | Atmosphere in temperature range 750° C.-850° C. in heating process of final annealing | Atmosphere at temperature ≥ 1100° C. in final annealing | Difference in maximum end-point temperature of coiled steel sheet in final annealing (° C.) | N content in forsterite coating (mass %) | Ti content in forsterite coating (mass %) | Al content in forsterite coating (mass %) | Average of forsterite grain size (μm) | Ratio of STD with respect to average forsterite grain size | $W_{17/50}$ (W/kg) | $B_8$ (T) | Note |
|---|---|---|---|---|---|---|---|---|---|---|---|---|---|
| 5 | | 2 | Ar:100% | | 60 | 1.8 | 1.5 | 1.2 | 0.45 | 2.10 | 0.68 | 1.93 | Example |
| 6 | | 2 | Ar:$N_2$ = 40:60 | | 65 | 3.3 | 1.5 | 3.2 | 0.42 | 2.50 | 0.72 | 1.93 | Comp. Example |
| 7 | | 3 | $N_2$ = 100% | | 35 | 3.9 | 2.2 | 4.3 | 0.30 | 0.80 | 0.73 | 1.93 | Comp. Example |
| 8 | | 3 | Ar:100% | | 10 | 1.6 | 2.2 | 1.5 | 0.46 | 1.20 | 0.67 | 1.93 | Example |
| 9 | | 3 | Ar:100% | | 25 | 1.6 | 2.2 | 1.5 | 0.22 | 0.40 | 0.65 | 1.93 | Example |
| 10 | | 4 | Ar:100% | | 30 | 2.4 | 3.5 | 2.9 | 0.32 | 0.60 | 0.68 | 1.93 | Example |
| 11 | | 4 | Ar:$H_2$ = 80:20 | | 30 | 3.2 | 4.1 | 3.8 | 0.30 | 0.60 | 0.73 | 1.93 | Comp. Example |
| 12 | | 6 | Ar:100% | | 30 | 3.5 | 4.5 | 2.8 | 0.25 | 0.60 | 0.73 | 1.93 | Comp. Example |
| 13 | B | 3 | Ar:$N_2$ = 50:50 | $H_2$:100% | 30 | 3.5 | 2.2 | 4.3 | 0.36 | 0.60 | 0.73 | 1.93 | Comp. Example |
| 14 | | 3 | Ar:100% | | 30 | 1.3 | 2.2 | 1.5 | 0.29 | 0.60 | 0.66 | 1.93 | Example |
| 15 | | 3 | Ar:$N_2$ = 50:50 | $N_2$:$H_2$ = 20:80 | 40 | 3.9 | 2.2 | 4.8 | 0.30 | 0.75 | 0.72 | 1.93 | Comp. Example |
| 16 | | 3 | Ar:100% | | 40 | 2.3 | 2.2 | 2.5 | 0.32 | 0.75 | 0.68 | 1.93 | Example |
| 17 | | 3 | Ar:100% | $N_2$:$H_2$ = 40:60 | 40 | 3.3 | 2.2 | 4.3 | 0.34 | 0.75 | 0.73 | 1.93 | Comp. Example |
| 18 | | 3 | Ar:100% | $N_2$:$H_2$ = 60:40 | 40 | 3.6 | 2.2 | 4.4 | 0.33 | 0.75 | 0.73 | 1.93 | Comp. Example |
| 19 | | 3 | Ar:100% | $N_2$:100% | 40 | 4.0 | 2.2 | 4.8 | 0.33 | 0.75 | 0.74 | 1.93 | Comp. Example |
| 20 | C | 0.3 | Ar:100% | Ar:100% | 25 | 1.3 | 0.3 | 0.8 | 0.32 | 0.45 | 0.69 | 1.92 | Example |
| 21 | | 2.5 | Ar:$H_2$ = 50:50 | | 25 | 4.2 | 1.8 | 4.1 | 0.35 | 0.45 | 0.73 | 1.92 | Comp. Example |
| 22 | | 2.5 | $H_2$:$N_2$ = 40:60 | | 25 | 4.3 | 1.8 | 4.1 | 0.37 | 0.45 | 0.74 | 1.92 | Comp. Example |
| 23 | | 2.5 | Ar:100% | | 25 | 1.5 | 1.8 | 0.8 | 0.37 | 0.45 | 0.67 | 1.92 | Example |
| 24 | | 2.5 | Ar:100% | | 10 | 1.5 | 1.8 | 1.0 | 0.58 | 1.50 | 0.68 | 1.92 | Example |
| 25 | | 6 | Ar:100% | | 25 | 3.8 | 4.6 | 2.2 | 0.40 | 0.45 | 0.74 | 1.92 | Comp. Example |
| 26 | D | 3 | Ar:100% | Ar:100% | 30 | 3.5 | 2.2 | 4.5 | 0.41 | 0.60 | 0.74 | 1.92 | Comp. Example |
| 27 | E | 3 | Ar:100% | $H_2$:100% | 30 | 3.3 | 2.2 | 3.8 | 0.38 | 0.60 | 0.74 | 1.92 | Comp. Example |
| 28 | F | 3 | Ar:100% | $H_2$:100% | 30 | 1.4 | 2.2 | 1.5 | 0.35 | 0.60 | 0.79 | 1.89 | Example |

It is understood from the results shown in Table 2 that the nitrogen content in the forsterite coating is suppressed to our range and very good iron loss properties can be obtained when composition and production conditions of the grain oriented electrical steel sheet are within our scope. Further, following facts were also confirmed.

Aluminum content in a slab exceeding our scope (Example No. 26) and nitrogen content in a slab exceeding our scope (Example No. 27) each exhibited an N content in the forsterite coating exceeding 3.0 mass % in spite of the optimum atmosphere in the final annealing, thereby failing to sufficiently reduce iron loss, although $B_8$ thereof was 1.91 T or more.

The steel composition not preferable when applied to the inhibitorless method (Example No. 28: too high Se content) resulted in $B_8$ lower than 1.91T (i.e. insufficient accumulation of crystal orientations in Goss orientation) and thus unsatisfactory reduction of iron loss.

Use of an atmosphere containing $N_2$ (Examples Nos. 6, 7, 13, 15, 22) and an atmosphere containing activated gas (Examples Nos. 11, 21) in the temperature range 750° C.-850° C. in the heating process of the final annealing, as well as use of an atmosphere having $N_2$ partial pressure set to exceed 25% in heating process of the final annealing at temperature equal to or higher than 1100° C. (Examples Nos. 17-19), unanimously resulted in a nitrogen content in the forsterite coating exceeding 3.0 mass %, thereby failing to sufficiently reduce iron loss in spite of $B_8$ being 1.91T or more. In other words, it is understood that setting the nitrogen content in the forsterite coating to be 3.0 mass % or less significantly improves iron loss properties of a resulting steel sheet.

Titanium content in $TiO_2$ conversion in the annealing separator exceeding 4 parts by mass with respect to 100 parts by mass of MgO resulted in a Ti content exceeding 4.0 mass % and N content exceeding 3.0 mass % in the forsterite coating and thus insufficient iron roll reduction in spite of use of the optimum atmosphere in the final annealing (Examples Nos. 12 and 25).

Comparison of Example No. 4 with Example No. 5 and comparison of Example No. 8 with Example No. 9 (Examples Nos. 4, 5, 8 and 9 are our steels reveal that setting the standard deviation of forsterite grain size to ≤1.0 time (preferably ≤0.75 times and more preferably ≤0.5 times) as much as the average of the forsterite grain size further improves iron loss properties, as compared with setting the standard deviation of forsterite grain size to >1.0 time as much as the average of the forsterite grain size. The standard deviation of forsterite grain size can be decreased by controlling the maximum difference in end-point temperature observed in the coiled steel sheet in the final annealing (e.g. controllably setting the maximum difference in end-point temperature to be within the range of 20° C. to 50° C.).

Comparison of Example No. 20 with Example No. 23, both of which are our steels, reveal that a Ti content in the forsterite coating ≥0.5 mass % further improves iron loss properties as compared with a Ti content in the forsterite coating <0.5 mass %. In this regard, a Ti content in the forsterite coating ≥0.5 mass % can be achieved by setting the Ti content in $TiO_2$ conversion in the annealing separator to be at least 0.5 parts by mass with respect to 100 parts by mass of MgO.

Comparison of Example No. 14 with Example No. 16, both of which are our steels, reveal that a nitrogen content in the forsterite coating 2.0 mass % further improves iron loss properties.

Comparison of Examples Nos. 4, 9 and 14 with Example No. 23 (Examples Nos. 4, 9, 14 and 23 are our steels) reveal that use of an atmosphere containing $H_2$ gas ($H_2$ gas: 100%) in the heating process of the final annealing at temperature equal to or higher than 1100° C. further improves iron loss properties, as compared with setting the atmosphere otherwise.

Iron loss difference $\Delta W_{17/50}$=0.05 W/kg corresponds to iron loss difference between two consecutive grades of a grain oriented electrical steel sheet.

INDUSTRIAL APPLICABILITY

It is possible to enhance an effect of reducing iron loss by magnetic domain refinement with a laser and further reduce iron loss of a steel sheet. Consequently, it is possible to obtain a transformer having high energy consumption efficiency by using the grain oriented electrical steel sheet as an iron core of the transformer.

The invention claimed is:

1. A grain oriented electrical steel sheet having a forsterite coating on a surface thereof, subjected to magnetic domain refinement by laser irradiation and having a magnetic flux density $B_8$ of at least 1.91T, wherein a nitrogen content in the forsterite coating is 3.0 mass % or less, and a standard deviation of forsterite grain size in the forsterite coating is equal to or less than 1.0 time as much as an average of the forsterite grain size.

2. The grain oriented electrical steel sheet of claim 1, wherein aluminum content and titanium content in the forsterite coating are 4.0 mass % or less and 0.5-4.0 mass %, respectively.

3. The grain oriented electrical steel sheet of claim 1, wherein the steel sheet contains Al: 0.01 mass % or less and N: 0.005 mass % or less.

4. A method of manufacturing a grain oriented electrical steel sheet, comprising:

preparing a steel slab such that aluminum and nitrogen contents thereof at a steelmaking stage are Al: 0.01 mass % or less and N: 0.005 mass % or less, respectively;

subjecting the steel slab to hot rolling and then cold rolling to obtain a cold rolled steel sheet;

subjecting the cold rolled steel sheet to decarburizing annealing;

coating a surface of the steel sheet with an annealing separator containing a titanium compound (other than a nitride) by 0.5 to 4 parts by mass in $TiO_2$ conversion with respect to 100 parts by mass of MgO;

employing an inert gas atmosphere not containing $N_2$ as an annealing atmosphere in a heating process of subsequent final annealing at least at a temperature of 750° C. to 850° C.;

employing a gas atmosphere of which $N_2$ partial pressure is controlled to 25% or less as an annealing atmosphere in the heating process of the final annealing at temperature equal to or higher than 1100° C.; and subjecting the steel sheet to magnetic domain refinement by laser irradiation after the final annealing;

wherein a maximum difference in end-point temperatures within a coiled steel sheet is controlled to 20° C. to 50° C. in the final annealing.

* * * * *